US007350333B2

(12) United States Patent
Michaud et al.

(10) Patent No.: US 7,350,333 B2
(45) Date of Patent: Apr. 1, 2008

(54) BRAKE DEVICE FOR GARAGE DOORS AND THE LIKE

(75) Inventors: Stephane Michaud, St-Nicephore (CA); Pascal Provencher, Drummondville (CA); Pierre-Louis Foucault, St-Lambert (CA)

(73) Assignee: Canimex Inc., Drummondville, Quebec ( * ) Notice: Subject to any disclaimer, the term of this patent is extended or adjusted under 35 U.S.C. 154(b) by 5 days.

(21) Appl. No.: 11/066,589

(22) Filed: Feb. 22, 2005

(65) Prior Publication Data

US 2005/0183341 A1 Aug. 25, 2005

(30) Foreign Application Priority Data

Feb. 20, 2004 (CA) ..... 2458157

(51) Int. Cl.
*E05F 3/16* (2006.01)

(52) U.S. Cl. ..... 49/322; 49/200; 160/201; 188/82.7

(58) Field of Classification Search ..... 49/322, 49/197, 199, 200, 451; 160/201; 188/82.7, 188/82.74, 82.77
See application file for complete search history.

(56) References Cited

U.S. PATENT DOCUMENTS

| | | | | |
|---|---|---|---|---|
| 4,385,471 | A | 5/1983 | Gabry et al. | |
| 5,090,522 | A | 2/1992 | Korff | |
| 5,243,783 | A * | 9/1993 | Schmidt et al. | 49/181 |
| 5,291,686 | A | 3/1994 | Sears et al. | |
| 5,581,939 | A | 12/1996 | Regan et al. | |
| 6,189,266 | B1 * | 2/2001 | Mihalcheon | 49/322 |
| 6,279,268 | B1 * | 8/2001 | Beaudoin et al. | 49/322 |
| 6,553,716 | B2 | 4/2003 | Bruns | |
| 6,640,496 | B2 | 11/2003 | Mullet | |
| 6,715,236 | B2 | 4/2004 | Mullet | |
| 6,928,696 | B2 * | 8/2005 | Wartman | 16/99 |
| 7,000,354 | B2 * | 2/2006 | Beaudoin et al. | 49/322 |
| 2002/0117787 | A1 | 8/2002 | Beaudoin et al. | |
| 2003/0000655 | A1 | 1/2003 | Martin | |

FOREIGN PATENT DOCUMENTS

| | | |
|---|---|---|
| DE | 27 35 123 A1 | 8/1979 |
| FR | 2 697 570 | 5/1994 |

* cited by examiner

*Primary Examiner*—Gregory J. Strimbu
(74) *Attorney, Agent, or Firm*—Merchant & Gould P.C.

(57) ABSTRACT

A brake device (1) is for use with a cable-operated door (3), such as garage doors (3) and the like. The device (1) is intended to reduce the risk of the door (3) falling, or at the very least slow down its descent, in the event of a failure in the counterbalancing mechanism of the door (3), which is generally represented by a loss of tension in a given tensioned cable (5) operating the door (3). The brake device (1) includes a support bracket (9), and a guiding assembly (15) and a braking assembly (17) mounted onto the support bracket (9). The braking assembly includes a swivel component (18) having a braking arm (19) and a lever portion (20), the lever portion cooperating with the tensioned cable (3) so that in the event of the loss of tension in the cable (5), the braking arm (19) is urged onto an adjacent rail (7) via a biasing spring (21) for anchoring a knife (45) of the braking arm (19) into the rail (7) and stopping, or at the very least, slowing down the descent of the door (3), with respect to the rail (7).

17 Claims, 19 Drawing Sheets

BRAKE DEVICE FOR GARAGE DOORS AND THE LIKE

FIELD OF THE INVENTION

The present invention relates to a brake device, also commonly known in the industry as a "stop bottom bracket", and also relates to a door assembly including the same. More particularly, the present invention relates to a braking device for use with a cable-operated door, such as garage doors and the like, and is used to reduce the risk of the garage door falling, or at the very least slow down its descent, in case of a rupture of one of the cables or in case of a failure of one of the elements (e.g. spring) of the counterbalancing mechanism that holds the cables and/or operates the door, these cases being generally represented by a loss of tension in a given cable.

BACKGROUND OF THE INVENTION

Cable-operated doors such as garage doors are well known in the art. A garage door is usually connected to an overhead counterbalancing mechanism that provides a counterbalancing force in order to decrease the force required to open the door and also facilitate its closing. A conventional garage door is typically connected to the counterbalancing mechanism by means of two cables, one at the right and one at the left. The cables are usually made of steel. The lower free end of each cable is usually attached at the bottom of the door.

It is also known in the art that a garage door needs to have a proper counterbalancing system so that it may be easily opened and closed. The counterbalancing force is generally achieved by the usage of either one or many torsional springs. Each torsional spring is generally connected to two plugs, a first one being the "winding plug" at one end of the spring, and a second one being the "stationary plug" at the other end of the spring. The winding plug is generally in turn fixed onto the shaft while the stationary plug is generally fixed onto a fixed structure, such as a bearing plate mounted to a wall for example. To transmit the force to the door, there are generally two drums on the shaft of the counterbalancing mechanism on which cables are installed. The extremities of these cables are generally fixed onto bottom brackets, one on each side (left and right) of the door, typically at the last or bottom panel of a sectional door for example.

One could envisage that, although very unlikely, it might happen that one of the elements (e.g. spring) of the counterbalancing mechanism which are operatively connected to the cables may undergo a failure, leading to the garage door falling, which is undesirable. There have been other attempts to come up with braking devices used in the event of a failure of a cable or of an element holding the same.

Known in the art are the following US and foreign patents/patent applications which describe various cable braking devices for garage doors and the like: U.S. Pat. Nos. 4,385,471; 5,090,522; 5,291,686; 5,581,939; 6,279,268B1; 6,553,716 B2; U.S. Pat. No. 6,640,496 B2; U.S. Pat. No. 6,715,236 B2; US 2002/0117787 A1; US 2003/0000655 A1; and FR 2,697,570.

However, most of the devices comprise detecting means which detect a loss of tension in the cable by means of levers, linkages, and the like which are either displaced along the same direction of the cable or in a direction perpendicularly thereto, which does not always enable a direct and sudden braking capability upon detection of the loss of tension in the cable. Furthermore, in order to carry out their braking functions, most of the above-mentioned devices rely on cams, and the like, which are used to frictionally engage or clamp a given portion of a side rail so as to brake the cable-operated door with respect to such a fixed structure. However, the braking capabilities of such devices rely mainly on the particular shape and eccentricity of the given cam.

Hence, in light of the above-discussed, there is a need for an improved brake device which would be able to overcome some of the aforementioned prior art problems.

SUMMARY OF THE INVENTION

The object of the present invention is to provide a brake device which, by virtue of its design and components, satisfies some of the above-mentioned needs, and which is thus an improvement over other related brake devices and/or methods known in the prior art.

In accordance with the present invention, the above object is achieved with a brake device for a cable-operated door operated by a tensioned cable, the cable-operated door having a movement guided along a fixed structure, the fixed structure having an inner portion and an outer portion, the brake device being mountable onto the cable-operated door and being configured for cooperating with the tensioned cable so as to immobilize the cable-operated door with respect to the fixed structure in the event of a loss of tension in the cable, the brake device comprising:

a support bracket mountable onto a bottom portion of the cable-operated door, the support bracket comprising:

- at least one hole for receiving each a corresponding fastener for securely mounting the support bracket onto the cable-operated door; and
- a connection point onto which an extremity of the tensioned cable is connected;

a guiding assembly operatively mounted onto the support bracket for travelling along the inner portion of the fixed structure so as to guide the movement of the cable-operated door along said fixed structure when the support bracket is mounted onto the bottom portion of the cable-operated door;

a braking assembly operatively mounted onto the support bracket for cooperating with the tensioned cable, the braking assembly comprising a swivel component pivotably mounted and moveable about the support bracket, the swivel component having opposite first and second ends, the first end being provided with a braking arm, and the second end being provided with a lever portion positioned, shaped and sized about the support bracket for cooperating with the tensioned cable, the braking arm projecting out from the support bracket for positioning of said braking arm adjacent to the outer portion of the fixed structure, the braking arm being operable between a retracted configuration, where the braking arm is urged away from the fixed structure via a frictional engagement of the tensioned cable against the lever portion opposite to the braking arm on the swivel component, so as to allow the guiding assembly to guide the cable-operated door freely along the fixed structure, and a braking configuration, caused by a given loss of tension in the cable resulting in a decrease of frictional engagement of the cable with the lever portion, where the braking arm is no longer urged away and thereby engages a portion of the outer portion of the fixed structure for braking movement of the cable-operated door with respect to the fixed structure;

biasing means operatively connected between the support bracket and the braking assembly for biasing the braking arm into a braking configuration; and a guiding channel defined within the lever portion of the swivel component for guiding the tensioned cable about the braking assembly and onto the connection point of the support bracket.

Preferably, the braking arm is provided with a knife having an edge extending from the braking arm for engaging with the outer portion of the fixed structure when in the braking configuration. The knife is preferably removably mounted onto the braking arm with at least one fastener, and said at least one fastener preferably comprises a pair of fasteners each comprising a bolt and a corresponding nut, each bolt being insertable through a corresponding hole provided along the braking arm.

Preferably also, the biasing means comprise a spring having one end operatively connected to the support bracket and another end operatively connected to the braking arm via a hinging portion thereof.

Preferably also, the brake device comprises a protective casing removably mountable onto the support bracket for substantially covering the support bracket and other components operatively connected thereto.

According to another aspect of the present invention, there is also provided a door assembly having a cable-operated door operated by a tensioned cable, the cable-operated door having a movement guided along a fixed structure, the fixed structure having an inner portion and an outer portion, the cable-operated door comprising a brake device configured for cooperating with the tensioned cable so as to immobilize the cable-operated door with respect to the fixed structure in the event of a loss of tension in the cable, the brake device comprising:

a support bracket mountable onto a bottom portion of the cable-operated door, the support bracket comprising:

at least one hole for receiving each a corresponding fastener for securely mounting the support bracket onto the cable-operated door; and a connection point onto which an extremity of the tensioned cable is connected;

a guiding assembly operatively mounted onto the support bracket for travelling along the inner portion of the fixed structure so as to guide the movement of the cable-operated door along said fixed structure when the support bracket is mounted onto the bottom portion of the cable-operated door;

a braking assembly operatively mounted onto the support bracket for cooperating with the tensioned cable, the braking assembly comprising a swivel component pivotably mounted and moveable about the support bracket, the swivel component having opposite first and second ends, the first end being provided with a braking arm, and the second end being provided with a lever portion positioned, shaped and sized about the support bracket for cooperating with the tensioned cable, the braking arm projecting out from the support bracket for positioning of said braking arm adjacent to the outer portion of the fixed structure, the braking arm being operable between a retracted configuration, where the braking arm is urged away from the fixed structure via a frictional engagement of the tensioned cable against the lever portion opposite to the braking arm on the swivel component, so as to allow the guiding assembly to guide the cable-operated door freely along the fixed structure, and a braking configuration, caused by a given loss of tension in the cable resulting in a decrease of frictional engagement of the cable with the lever portion, where the braking arm is no longer urged away and thereby engages a portion of the outer portion of the fixed structure for braking movement of the cable-operated door with respect to the fixed structure;

biasing means operatively connected between the support bracket and the braking assembly for biasing the braking arm into a braking configuration; and a guiding channel defined within the lever portion of the swivel component for guiding the tensioned cable about the braking assembly and onto the connection point of the support bracket.

According to yet another aspect of the present invention, there is also provided a method of operating the above-mentioned brake device and/or door assembly.

According to yet another aspect of the present invention, there is also provided a kit for assembling the above-mentioned brake device.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

Figure 1:
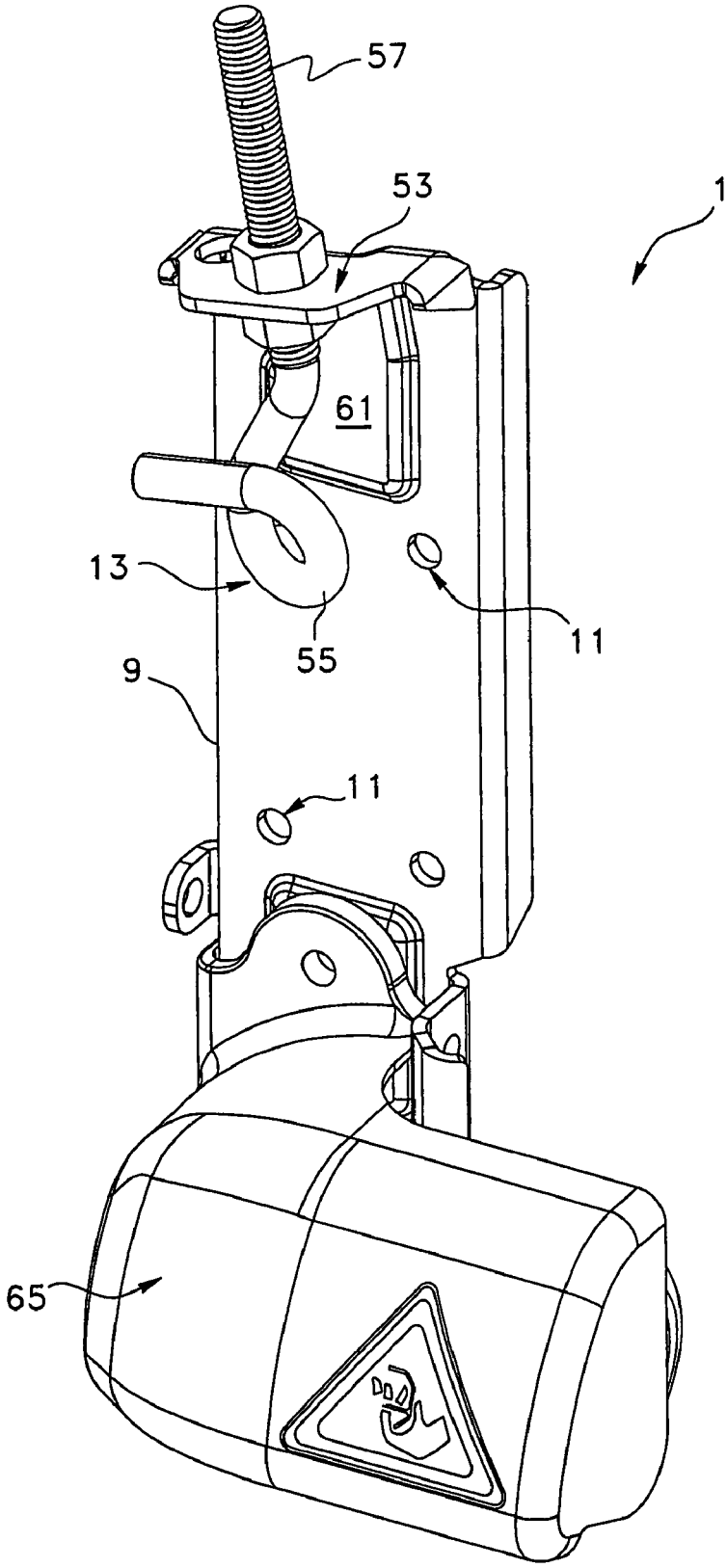
FIG. 1 is a perspective view of a brake device according to a preferred embodiment of the present invention.

In the following description, the same numerical references refer to similar elements. The embodiments shown in the figures are preferred, and are used for exemplification purposes.

Moreover, although the present invention was primarily designed for use with a cable-operated door, such as a garage door assembly for example, it may be used with other types of doors and objects and in other fields, as apparent to a person skilled in the art. For this reason, expressions such as "cable", "garage", "door", etc., as used herein should not be taken as to limit the scope of the present invention and includes all other kinds of doors and/or items with which the present invention could be used and may be useful.

Moreover, in the context of the present invention, the expressions "driving mechanism", "controlling mechanism", "counterbalancing mechanism", and any other equivalent expression known in the art will be used interchangeably. Furthermore, the same applies for any other mutually equivalent expressions, such as "cable-operated door" and "garage door", "braking arm" and "lever arm", as well as "braking" and "slowing down descent rate" for example, as also apparent to a person skilled in the art.

In addition, although the preferred embodiment of the present invention as illustrated in the accompanying drawings comprises various components such as a guiding channel 23, a roller 27, a shaft 29, a sleeve 31, a spring 63, a casing 65, etc., and although the preferred embodiment of the brake device 1 as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the brake device 1 and corresponding parts according to the present invention, as briefly explained and as can be easily inferred herefrom by a person skilled in the art, without departing from the scope of the invention.

Broadly described, the brake device 1 according to the present invention, as shown in the accompanying drawings, is a device 1 for use with a cable-operated door 3, such as garage doors 3 and the like, for providing advantages in that it is intended to slow down its descent, in the event of a failure in the counterbalancing mechanism of the cable-operated door 3, such as, for example, a rupture of one of the cables 5 or a failure of one of the elements (e.g. torsional spring) operatively connected to the cables 5, which is generally represented by a loss of tension in the given cable 5 operating the cable-operated door 3. The brake device 1 according to the present invention is intended to reduce the risk that the garage door 3 will fall, or at the very least, it will slow down its descent, so as to minimize the occurrence of damages to property, and the like.

Indeed, according to the present invention, the brake device 1 is intended for a cable-operated door 3 operated by a tensioned cable 5, the cable-operated door 3 having a movement guided along a fixed structure 7, such as a guide or side rail for example, as better shown in FIGS. 5-21, the fixed structure 7 having an inner portion 7*a* and an outer portion 7*b*. The brake device 1 is devised to be mountable onto the cable-operated door 3, at a suitable location thereon, such as a bottom portion thereof or a bottom panel of a sectional door 3 for example, and is configured for cooperating with the tensioned cable 5 so as to immobilize the cable-operated door 3 with respect to the fixed structure 7 in the event of a loss of tension in the cable 5, which represents typically a failure in the counterbalancing mechanism (not shown) of the door 3 such as, as aforementioned, a rupture of one of the cables 5, a failure of one of the elements (for example, a torsional counterbalancing spring) operatively connected to the cables 5 of the counterbalancing mechanism, and/or other similar situations, as apparent to a person skilled in the art.

As better shown in the accompanying drawings, the brake device 1 comprises a support bracket 9, a guiding assembly 15, a braking assembly 17, biasing means 21, and a guide channel 23.

Figure 2:
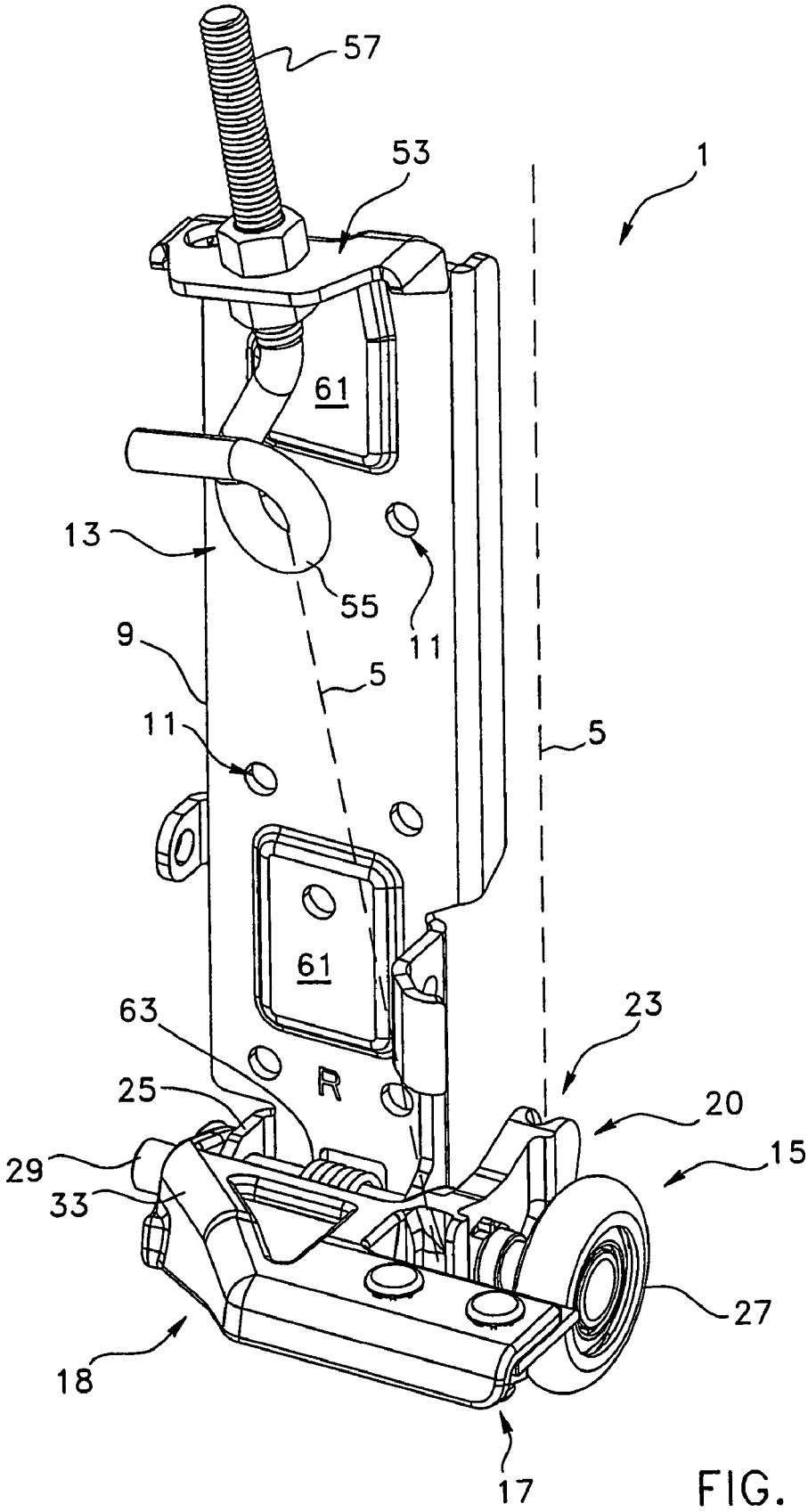
FIG. 2 is another perspective view of what is shown in FIG. 1, the brake device being now shown without its protective casing, and cooperating with a tensioned cable represented schematically by a dotted line.
Figure 3:
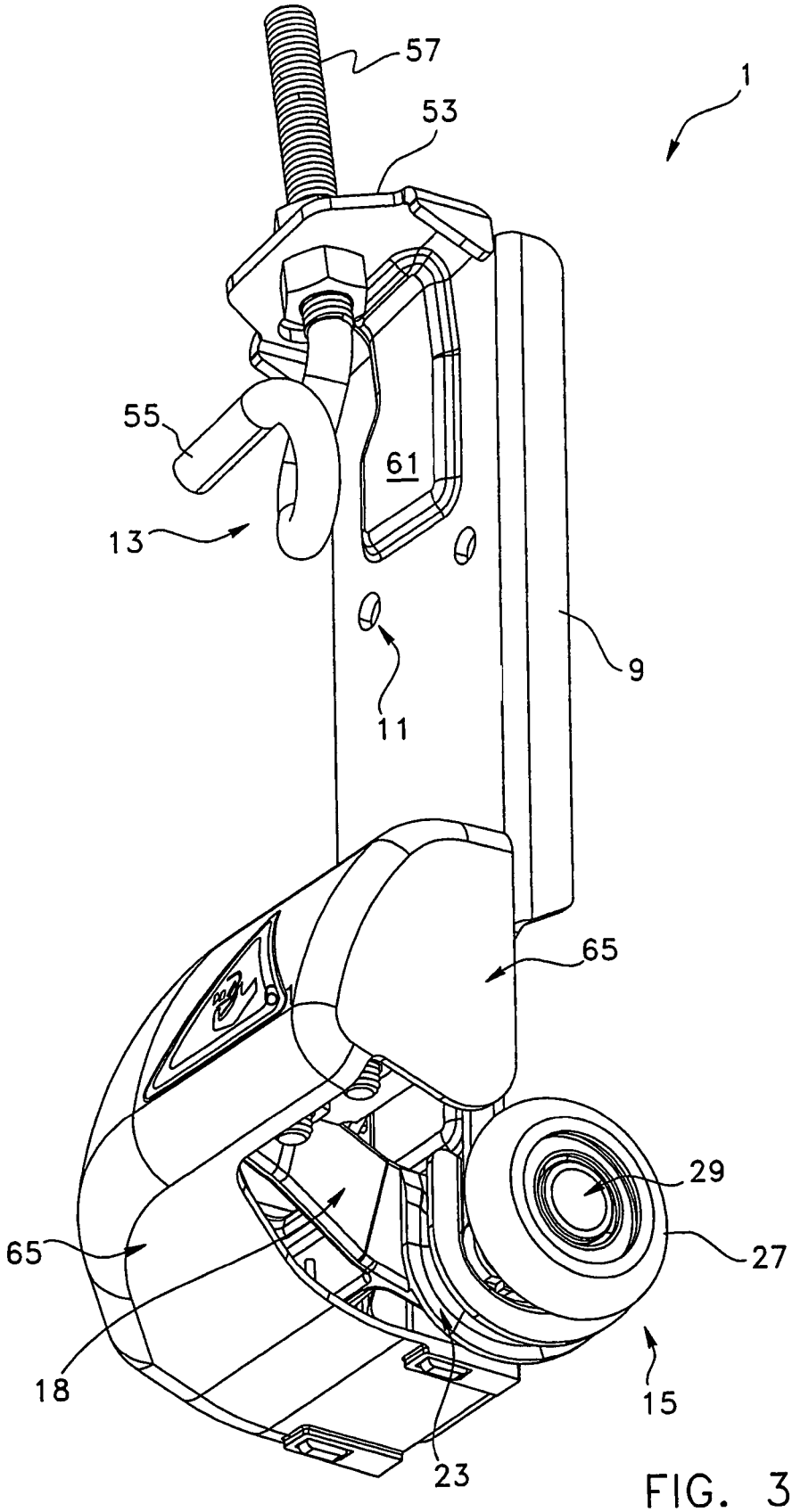
FIG. 3 is a bottom perspective view of what is shown in FIG. 1.

The support bracket 9 is preferably mountable onto a bottom portion of the cable-operated door 3, such as the bottom panel of a sectional garage door for example, and preferably comprises at least one hole 11 for receiving each a corresponding fastener (not shown) for securely mounting the support bracket 9 onto the cable-operated door 3, as can be easily understood when referring to FIGS. 5-24, and the support bracket 9 also preferably comprises a connection point 13 onto which an extremity of the tensioned cable 5 is connected. In FIG. 2 for example, the tensioned cable 5 has been represented schematically by a dotted line.

As better shown in FIGS. 1-10, the guiding assembly 15 according to the present invention is operatively mounted onto the support bracket 9 for traveling along the inner portion 7*a* of a fixed structure 7 so as to guide the movement of the cable-operated door 3 along said fixed structure 7 when the support bracket 9 is mounted onto the bottom portion of the cable-operated door 3. It is to be understood, as apparent to a person skilled in the art, that a conventional door usually has a plurality of guiding assemblies (e.g. rollers) for guiding the cable-operated door 3 along said fixed structure 7, such as a side rail for example, and that the brake device 1 according to the present invention is not absolutely necessary for guiding the cable-operated door 3 along said fixed structure 7, but preferably takes the place of a bottom guiding assembly which would otherwise be normally present in a conventional door, while at the same time providing safety advantages, as described herein.

Figure 4:
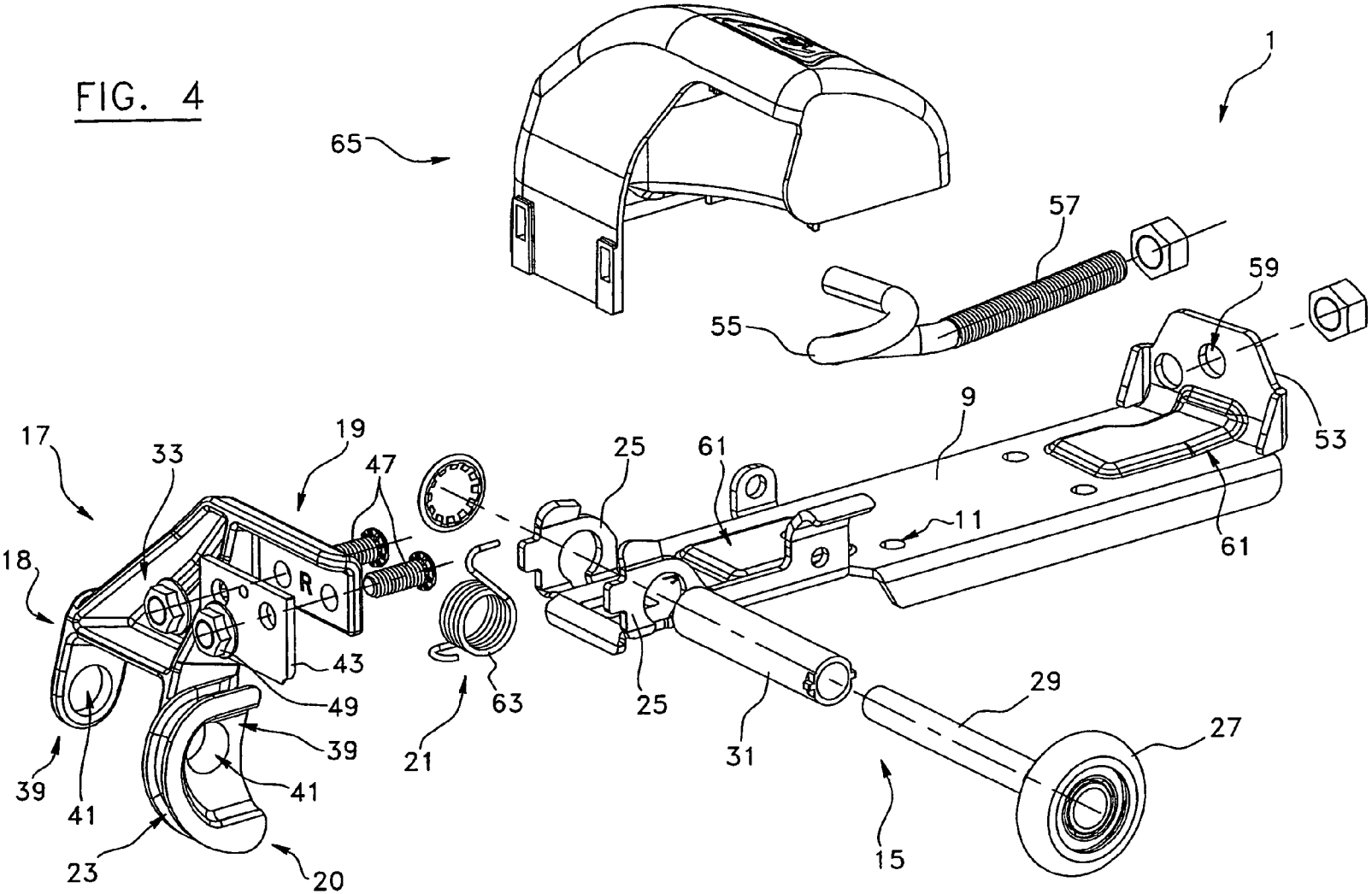
FIG. 4 is an exploded view of the brake device shown in FIG. 1.
Figure 5:
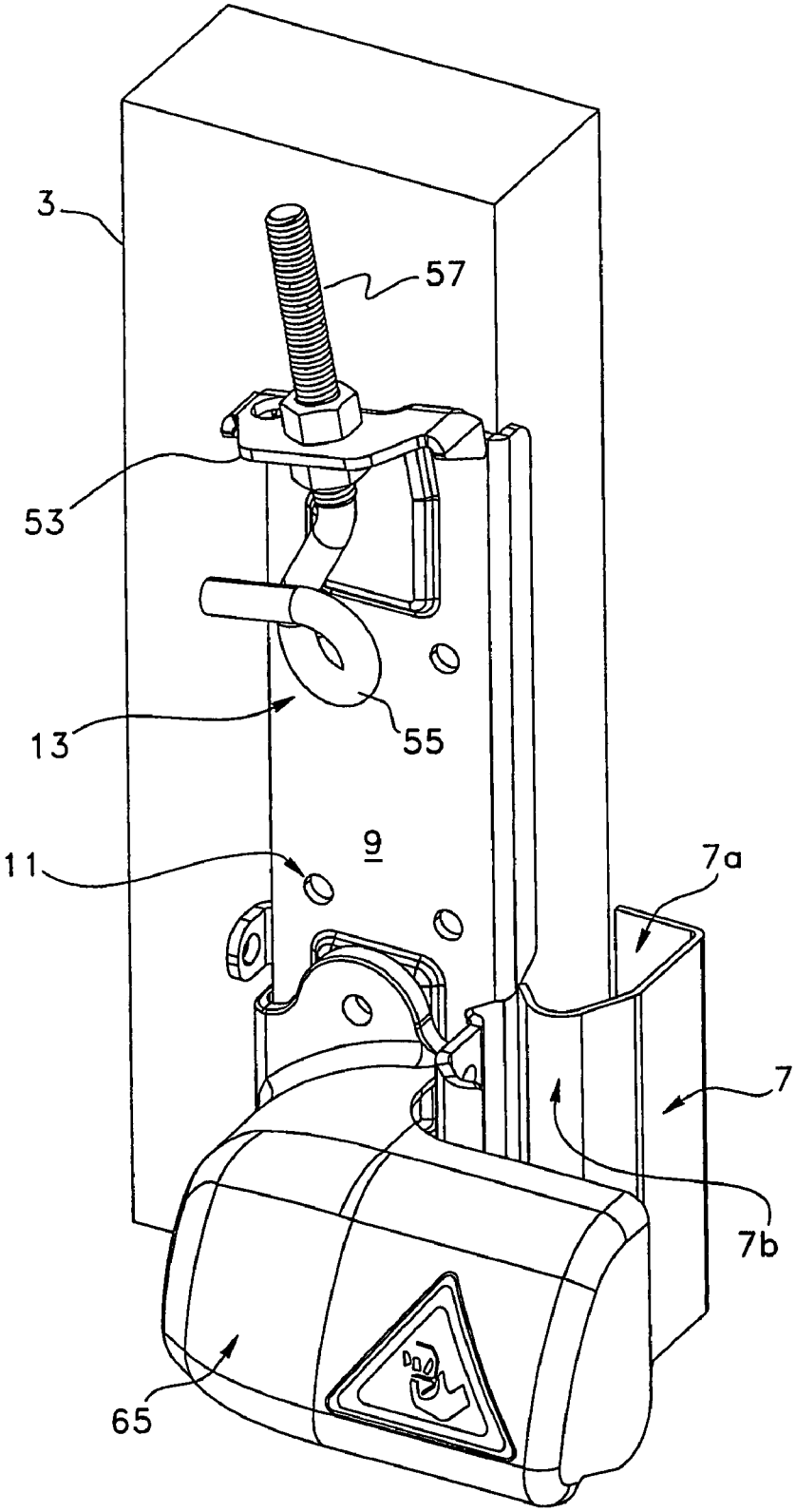
FIG. 5 is a partial perspective view of a bottom portion of a door assembly provided with a brake device such as the one shown in FIG. 1.
Figure 6:
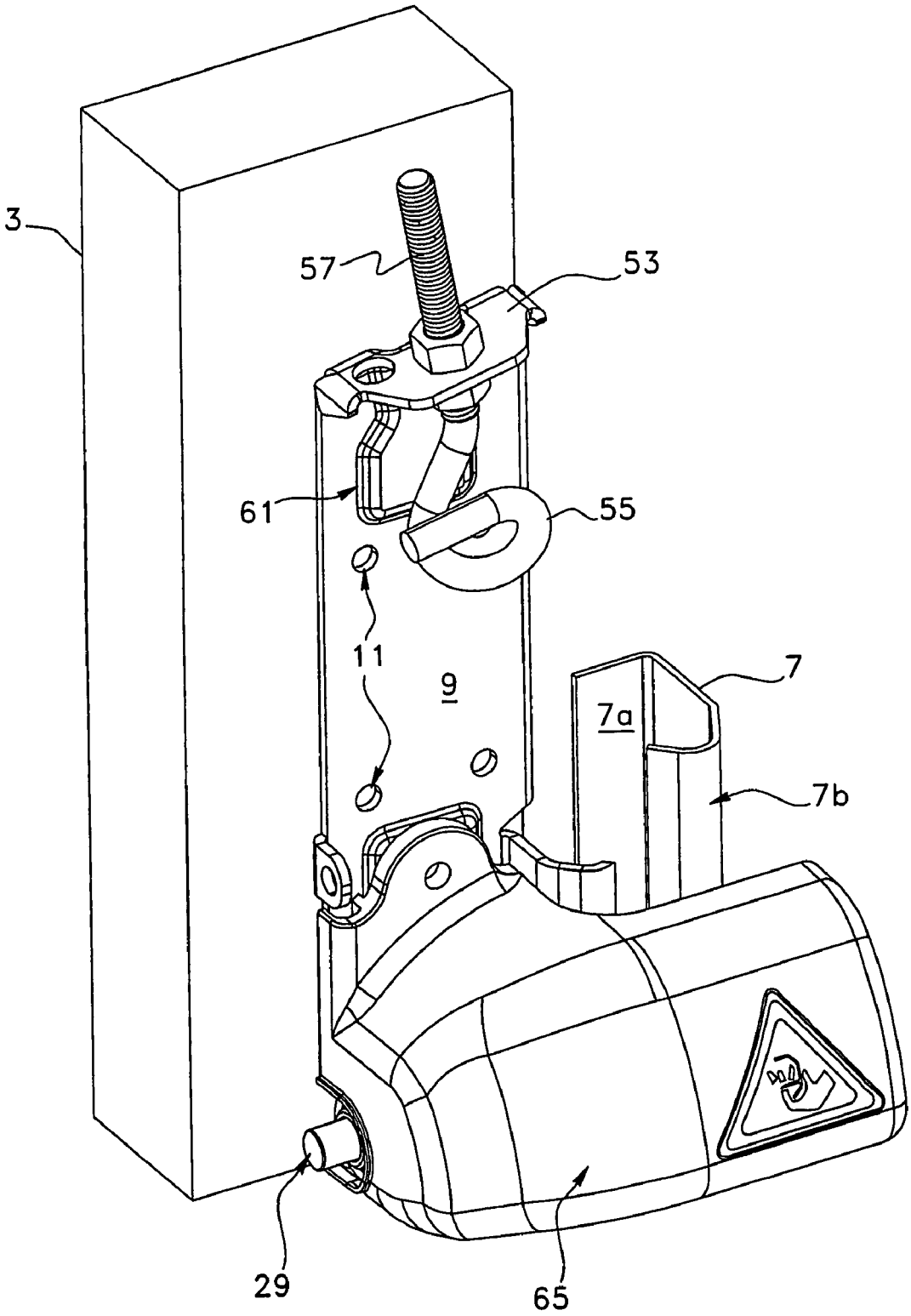
FIG. 6 is another perspective view of what is shown in FIG. 5.
Figure 7:
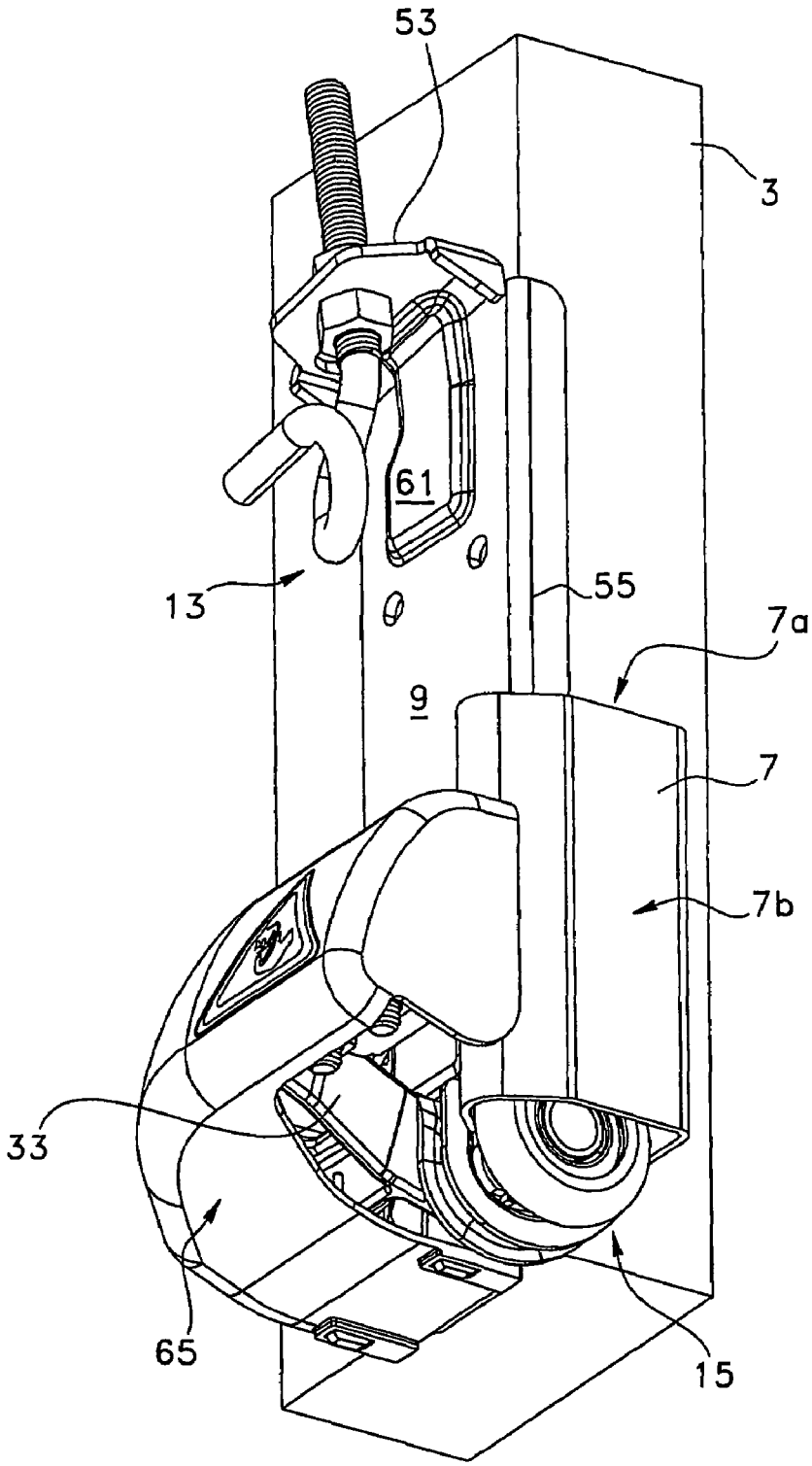
FIG. 7 is a bottom perspective view of what is shown in FIG. 5.
Figure 8:
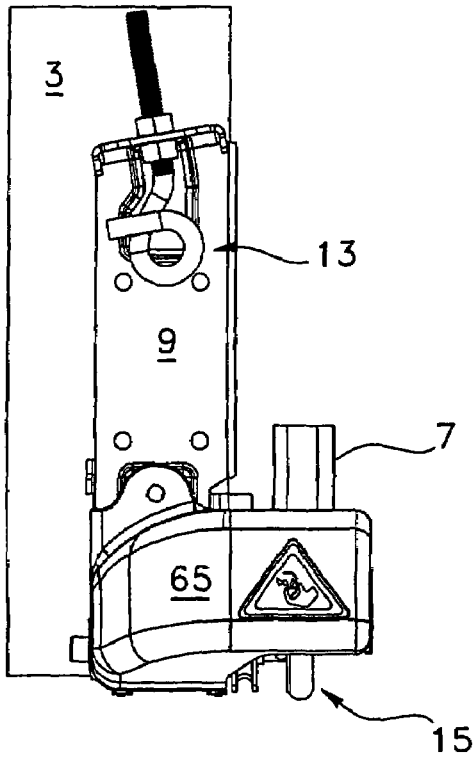
FIG. 8 is a front plan view of what is shown in FIG. 5.
Figure 10:
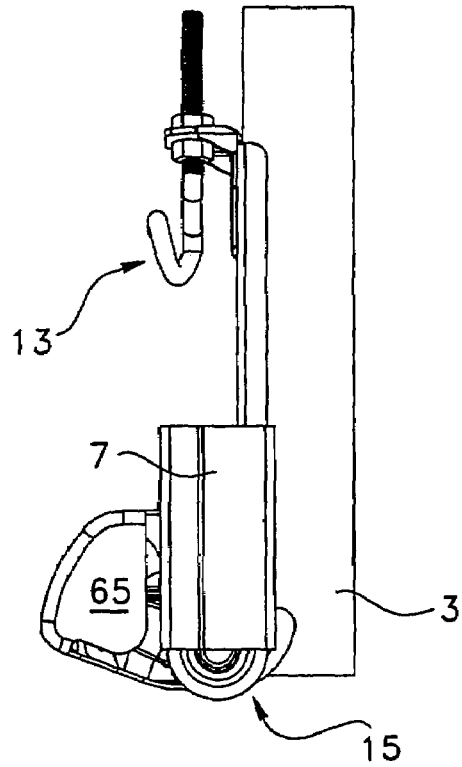
FIG. 10 is a side plan view of what is shown in FIG. 8.
Figure 9:
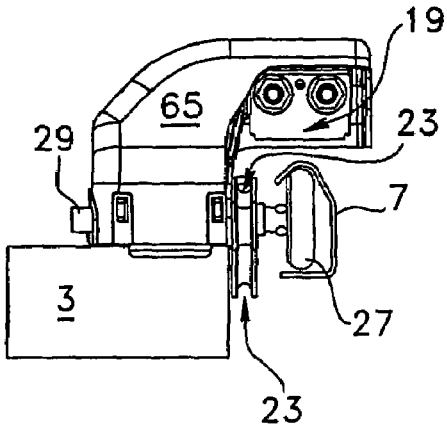
FIG. 9 is a bottom plan view of what is shown in FIG. 8.
Figure 11:
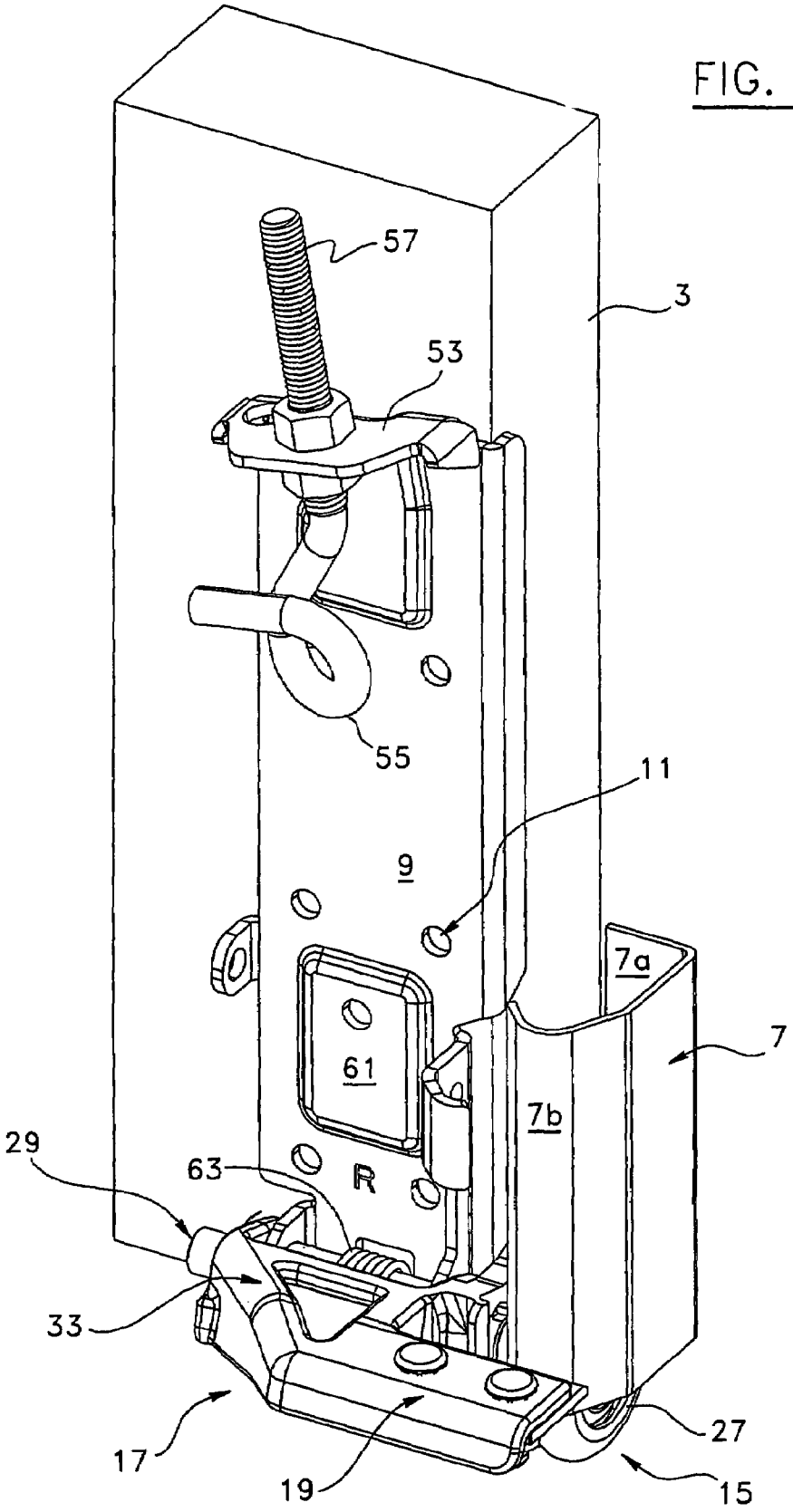
FIG. 11 is another perspective view of what is shown in FIG. 5, the brake device being now shown without its protective casing.
Figure 12:
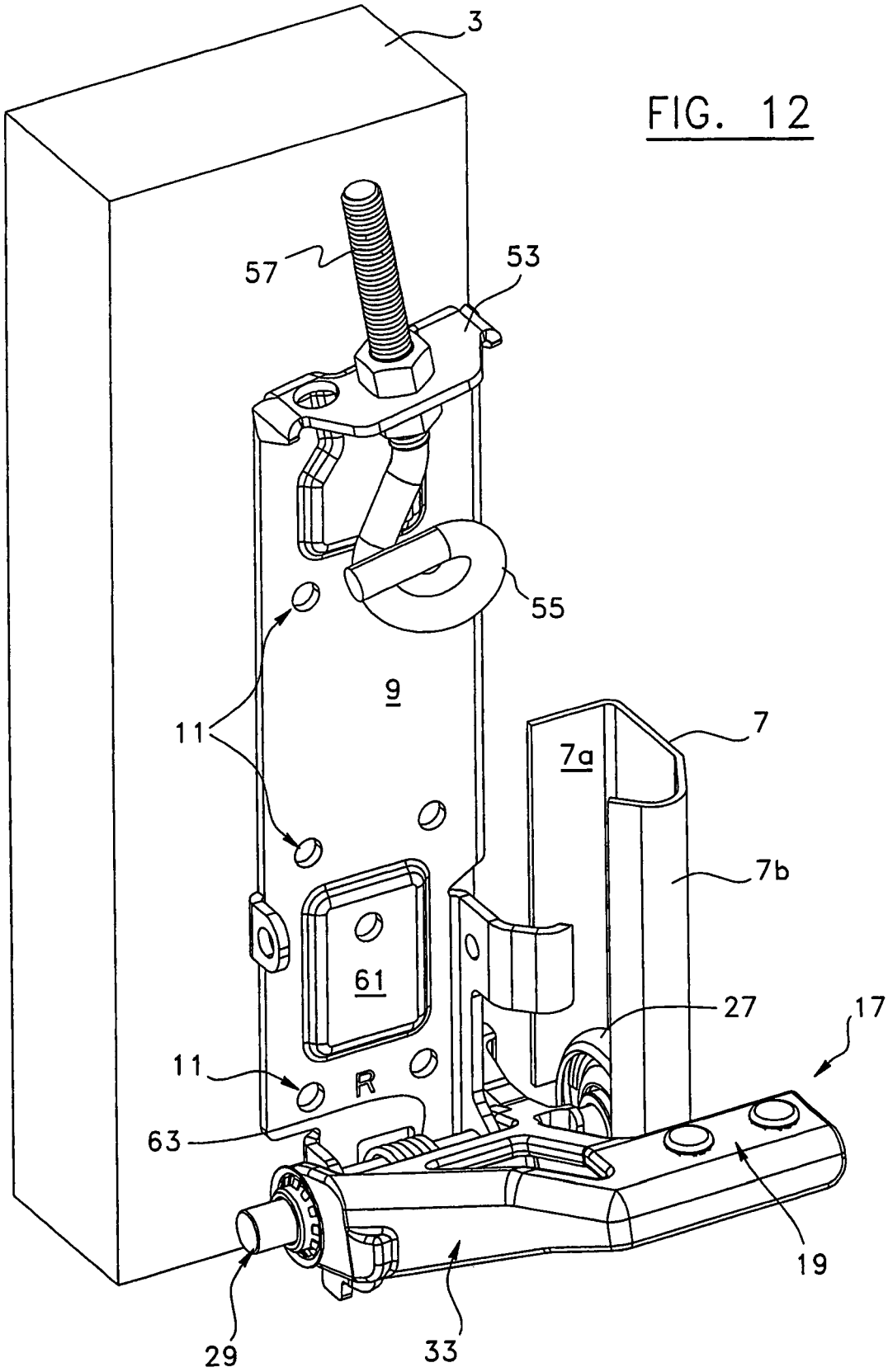
FIG. 12 is another perspective view of what is shown in FIG. 11.
Figure 13:
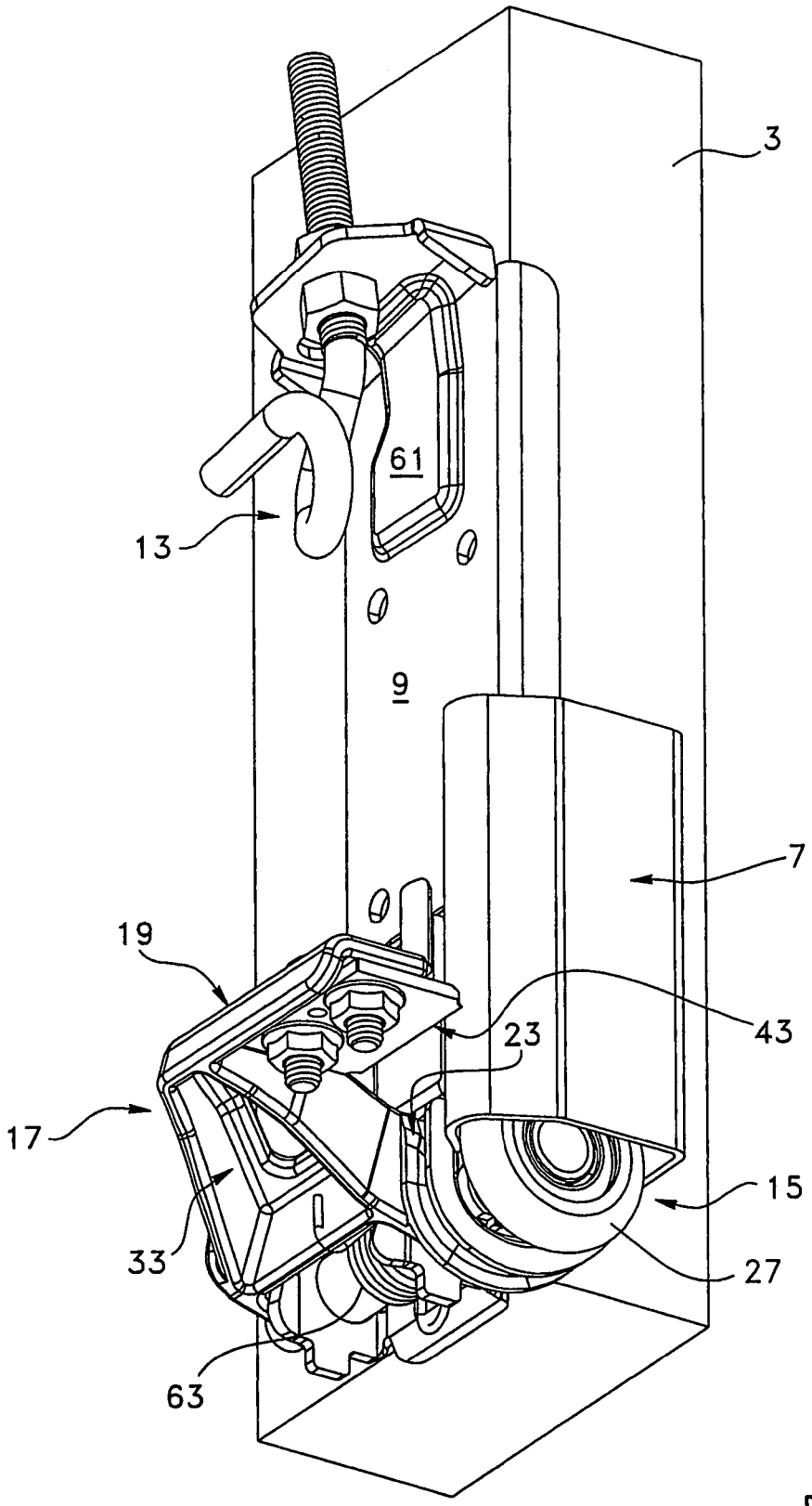
FIG. 13 is a bottom perspective view of what is shown in FIG. 11.
Figure 14:
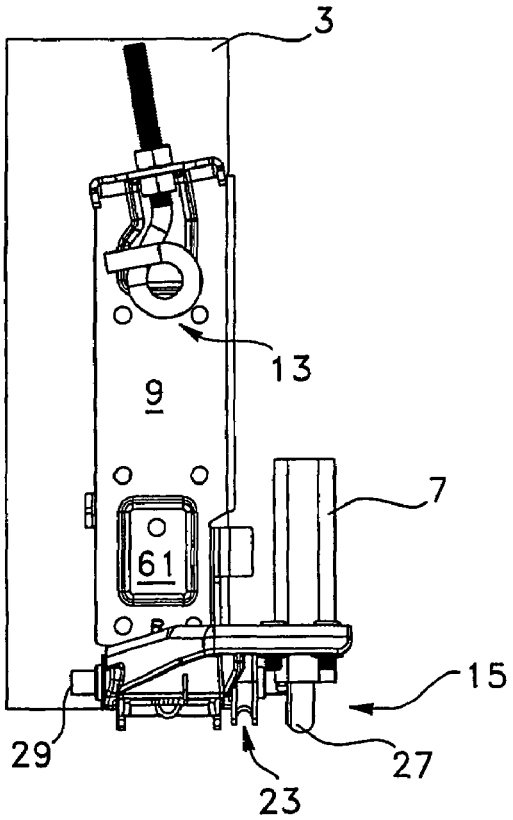
FIG. 14 is a front plan view of what is shown in FIG. 11.
Figure 16:
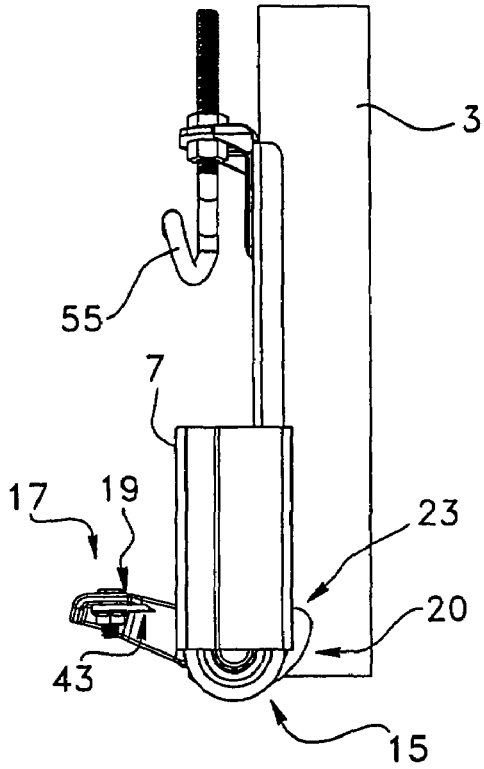
FIG. 16 is a side plan view of what is shown in FIG. 14.
Figure 15:
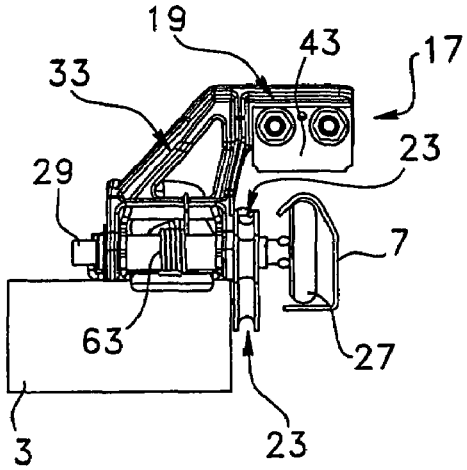
FIG. 15 is a bottom plan view of what is shown in FIG. 14.
Figure 17:
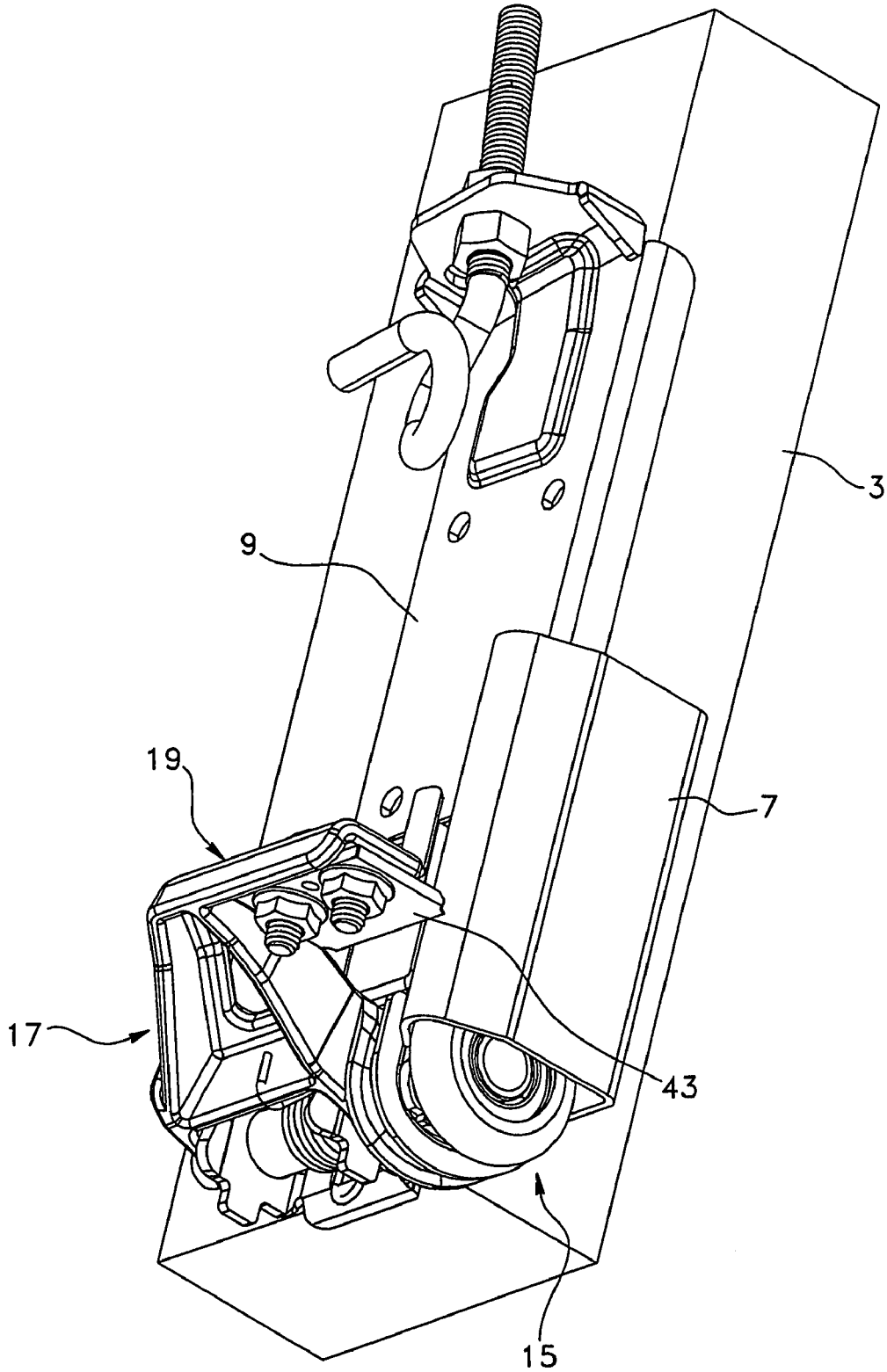
FIG. 17 is a partial perspective view of a bottom portion of a door assembly provided with a brake device such as the one shown in FIG. 1, the brake device being shown in a retracted configuration according to a preferred embodiment of the present invention.
Figure 18:
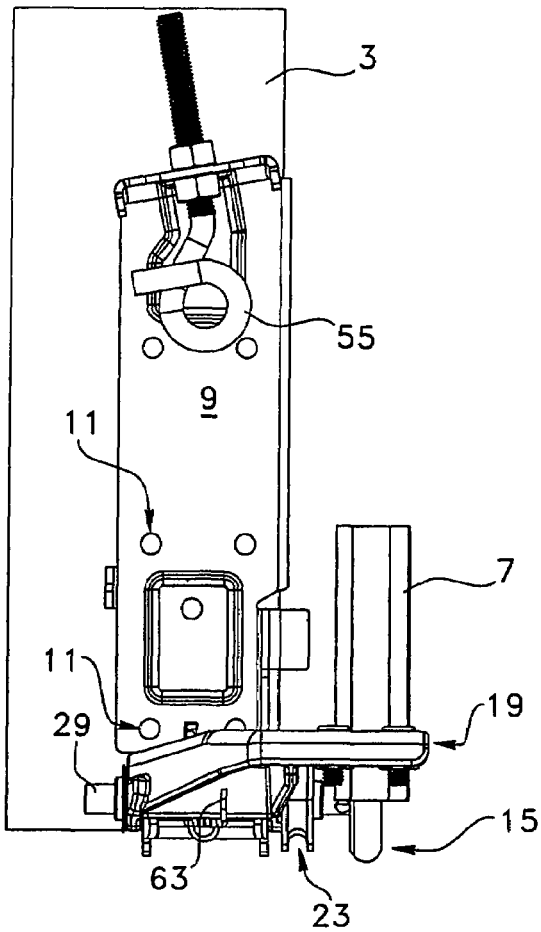
FIG. 18 is a front plan view of what is shown in FIG. 17.
Figure 20:
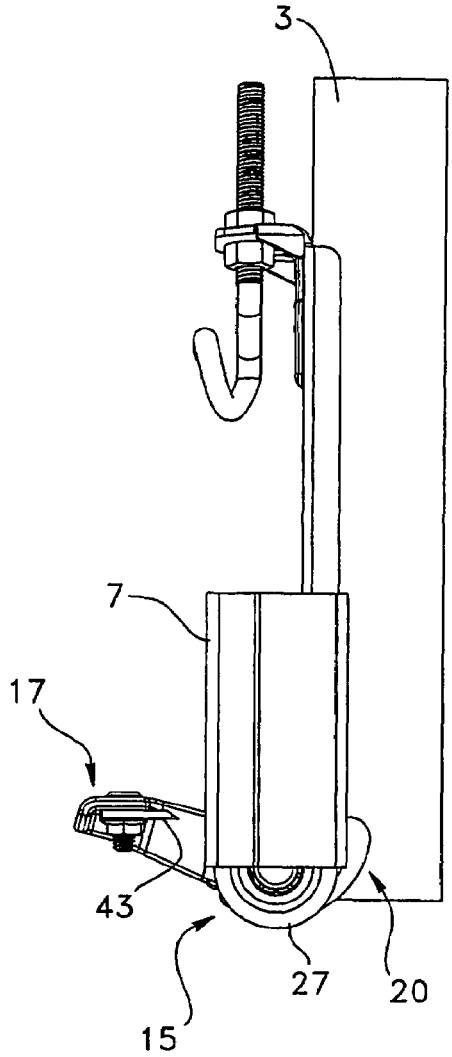
FIG. 20 is a side plan view of what is shown in FIG. 18.
Figure 19:
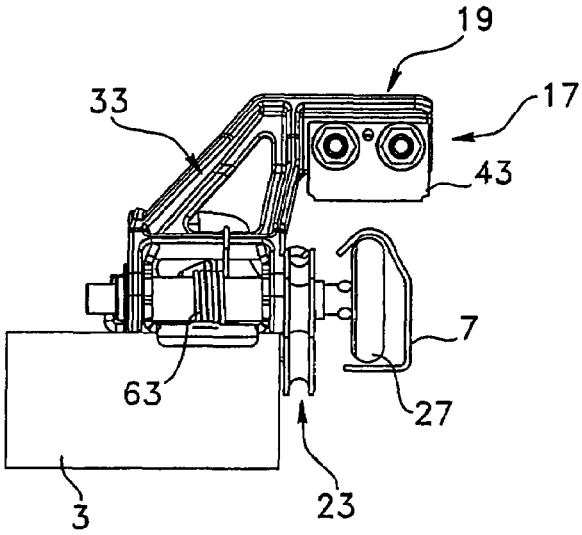
FIG. 19 is a bottom plan view of what is shown in FIG. 18.
Figure 21:
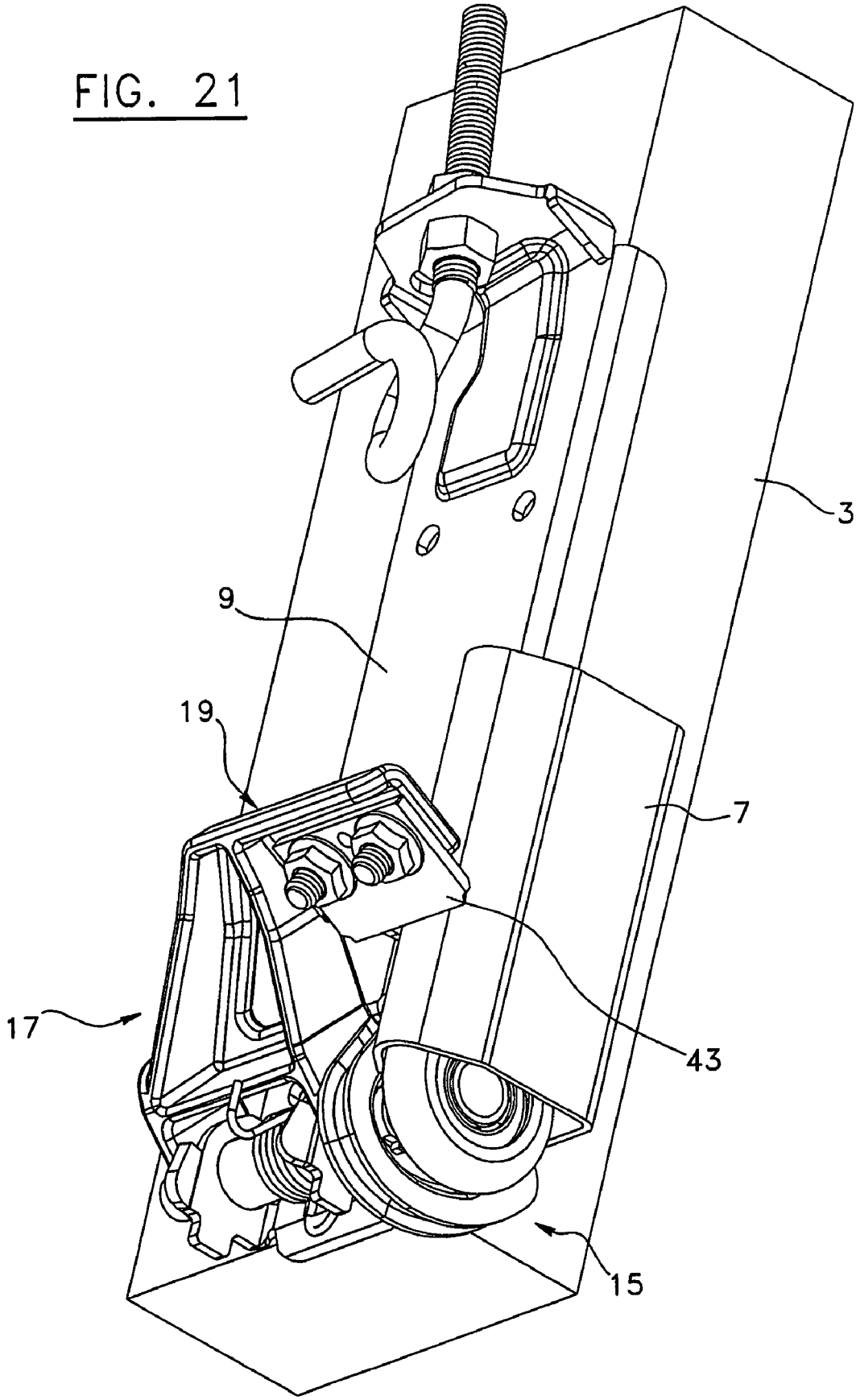
FIG. 21 is another perspective view of what is shown in FIG. 17, the brake device being now shown in a braking configuration according to a preferred embodiment of the present invention.
Figure 22:
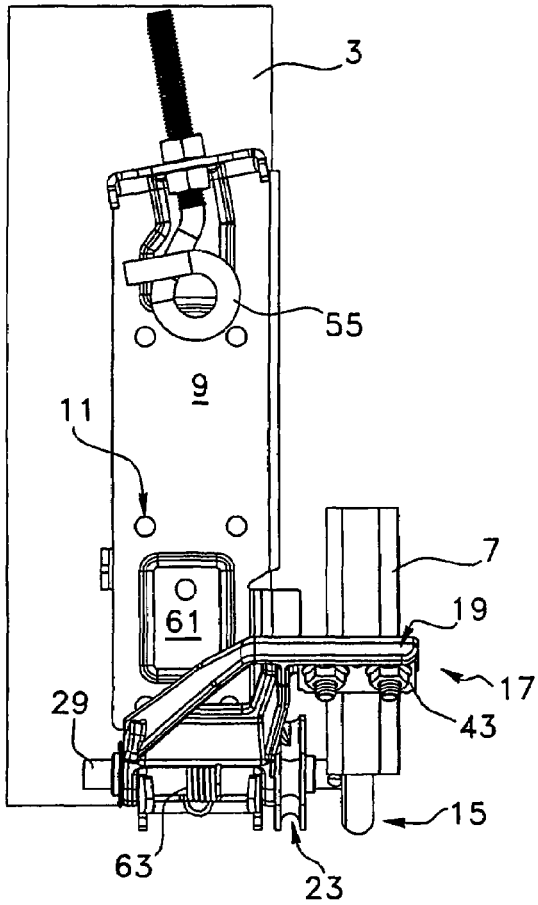
FIG. 22 is a front plan view of what is shown in FIG. 21.
Figure 24:
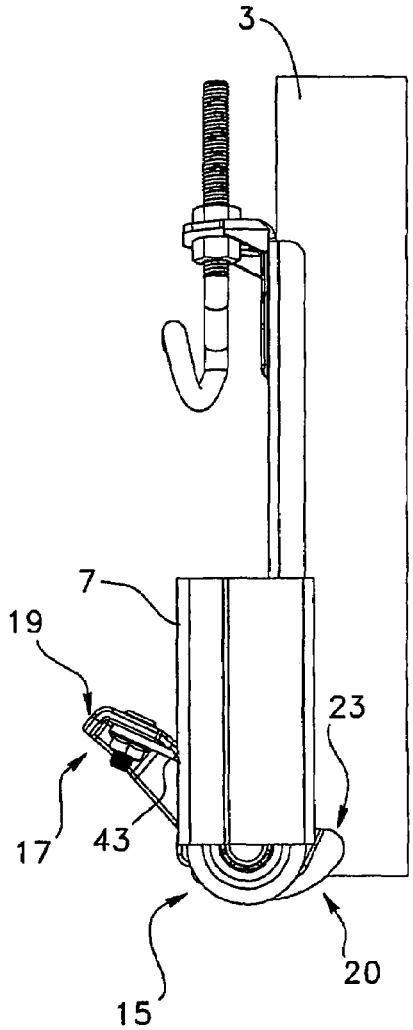
FIG. 24 is a side plan view of what is shown in FIG. 22.
Figure 23:
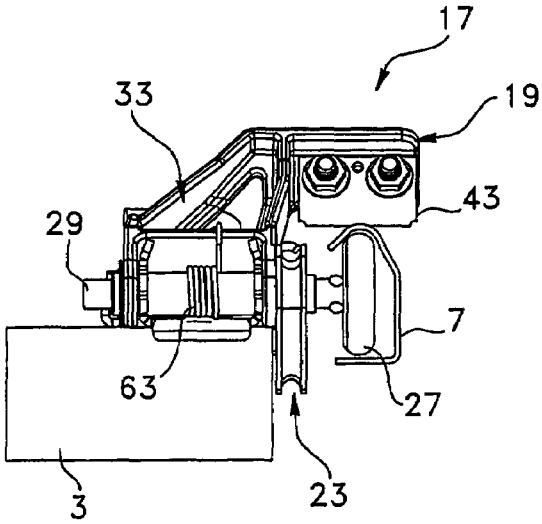
FIG. 23 is a bottom plan view of what is shown in FIG. 22.

As can be easily understood when referring to FIGS. 2 and 4, the braking assembly 17 of the present brake device 1 is operatively mounted onto the support bracket 9 thereof for cooperating with the tensioned cable. The braking assembly 17 comprises a swivel component 18 pivotably mounted and movable about the support bracket 9. This swivel component 18 has first and second opposite ends, the first end being provided with a braking arm 19, and the second end being provided with a lever portion 20, said lever portion 20 being positioned, shaped and sized about the support bracket 9 for cooperating with the tensioned cable 5. Preferably, the braking arm 19 and lever portion 20 are thus rigidly connected thereto, so that movement (i.e. rotation) of one causes an opposite movement of the other. They also preferably have a common pivot axis (i.e. pivot axis of shaft 29 and/or of sleeve 31, as explained hereinbelow), and are thus pivotally moveable with respect to the support bracket 9, as can be easily understood when contrasting FIGS. 17-20 and 21-24. Moreover, as also shown, the braking arm 19 projects out from the support bracket 9 for positioning of the braking arm 19 adjacent to the outer portion 7*b* of the fixed structure 7, as also illustrated in the above-mentioned figures. The braking arm 19 is operable between a retracted configuration, better illustrated in FIGS. 17-20, and a braking or "engaged" configuration, as better illustrated in FIGS. 21-24. In the retracted configuration, and as can be easily understood when referring to FIGS. 2 and 17-20, the braking arm 19 is urged away from the fixed structure 7 via a frictional engagement of the tensioned cable 5 against the lever portion 20 opposite to the braking arm 19 on the swivel component 18, so as to allow the guiding assembly 15 to guide the cable-operated door 3 freely along the fixed structure 7. However, when in the braking or "engaged" configuration, caused by a loss of tension in the cable 5 resulting in a decrease of frictional engagement of the cable 5 with the lever portion 20, the braking arm 19 is no longer urged away, i.e. not biased anymore by the tensioned cable 5 pushing on the lever portion 20 and is thereby allowed to engage a portion of the outer portion 7*b* of the fixed structure 7 for braking movement of the cable-operated door 3 with respect to the structure, said engagement being driven not only by the design and the nature of the braking arm 19, as will be explained in greater detail hereinbelow, but also driven by biasing means 21, as also described hereinbelow, and as apparent to a person skilled in the art.

Indeed, the biasing means 21 are operatively connected between the support bracket 9 and the braking assembly 17 for biasing the braking arm 19 into a braking configuration, that is, for urging the braking arm 19 constantly towards the outer portion 7*b* of the fixed structure 7. Thus, as may now better be appreciated, when there is tension in the tensioned cable 5, the tensioned cable 5 overrides the biasing force of the biasing means 21 (e.g. springs 63) and pushes on the lever portion 20 of the swivel component 18, thereby urging the braking arm 19 away from the fixed structure 7 (i.e. side rail), whereas when there is a loss of tension in the cable 5, said cable 5 no longer pushes against the lever portion 20 and can no longer urge the braking arm 19 away from the fixed structure 7, and thus the braking arm 19 is in turn allowed and driven by the biasing means 21 towards the outer portion 7*b* of the fixed structure 7 (e.g. rail), and is designed in such a way that it engages the side rail in a frictional and/or deformable manner (by cutting, notching, etc., itself therein) so that once it is anchored into the side rail, the cable-operated door 3 is prevented or slowed down from falling.

The braking device 1 according to the present invention also preferably comprises a guiding channel 23 defined within the lever portion of the swivel component for guiding the tensioned cable 5 about the braking assembly 17 and onto the connection point 13 of the support bracket 9, as better represented in FIG. 2.

Preferably, and as better shown in FIGS. 2, 4, 25 and 26, the support bracket 9 comprises a pair of support arms 25 and the guiding assembly 15 comprises a roller 27 mounted about a shaft 29, said shaft 29 being rotatably mounted about said support arms 25.

Preferably also, and as better shown in FIG. 4, the guiding assembly 15 comprises a sleeve 31 rotatably mounted about the support arms 25, and the shaft 29 of the roller 27 is further rotatably mounted within the sleeve 31.

Preferably also, and as better shown in FIGS. 4 and 27-29, the braking arm 19 has a hinging portion 33 pivotably mounted about the sleeve 31. The hinging portion 33 preferably comprises a pair of hinging flanges 39 each having a corresponding orifice 41 for the sleeve 31 to pass therethrough.

Preferably also, and as better shown in FIGS. 2, 4 and 27-29, the guiding channel 23 is operatively connected to the hinging portion 33 of the braking arm 19, and is preferably made integral to said hinging portion 33. It is worth mentioning though that the braking arm 19, lever portion 20, guiding channel 23, and hinging portion 33 according to the present invention may take on various other suitable embodiments. Indeed, the may consist of a single component, and may be made integral to each other (i.e. same component made out of the same material), as shown in the accompanying drawings, or may be defined by various separate components connectable to each other by suitable means, as apparent to a person skilled in the art.

Preferably, and as better shown in FIGS. 2, 4, 14-24 and 27, the braking arm 19 is provided with a knife 43 having an edge extending from the braking arm 19 for engaging with the outer portion 7*b* of the fixed structure 7 when in the braking configuration. The knife 43 is preferably removably mounted onto the braking arm 19 with at least one fastener 45. Said at least one fastener 45 preferably comprises a pair of fasteners 45 each comprising a bolt 47 and a corresponding nut 49, each bolt 47 being insertable through a corresponding hole 51 provided along the braking arm 19. It is worth mentioning that other suitable means may be used for properly securing the knife 43 onto the braking arm 19, as apparent to a person skilled in the art. For example, a given knife 43 could be made integral to the braking arm 19, that is, made of one single component and made out of the same material, in which case said knife 43 would also act as the braking arm 19 itself, as also apparent to a person skilled in the art.

Preferably, and as better shown in FIGS. 1-4, the support bracket 9 comprises a supporting flange 53, and the connection point 13 comprises a hook 55 having a threaded portion 57 removably insertable into a corresponding hole 59 of the supporting flange 53. It is also to be understood that other suitable connection points 13 and means for connecting it to the support bracket 9 may be included according to the present invention, and as also apparent to a person skilled in the art.

Preferably, and as better shown in FIGS. 2, 4, 25 and 26, the support bracket 9 comprises at least one embossment 61 for increasing the structural integrity of the support bracket 9.

Preferably, and as better shown in FIGS. 2, 4, 13, 15 and 19, the biasing means 21 comprise a spring 63 having one end operatively connected to the support bracket 9 and another end operatively connected to the braking arm 19 via the hinging portion 33 thereof.

Preferably, and as better shown in FIGS. 1, 3, 4 and 30-32, the brake device 1 comprises a casing 65 removably mountable onto the support bracket 9 for substantially covering the support bracket 9 and other components operatively connected thereto.

Figure 25:
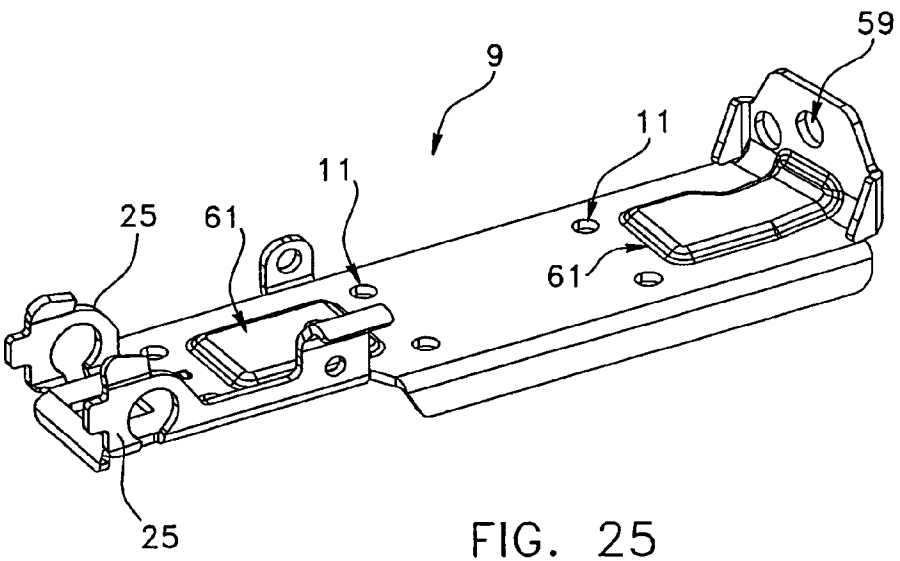
FIG. 25 is a perspective view of the support bracket of the brake device shown in FIG. 4.
Figure 26:
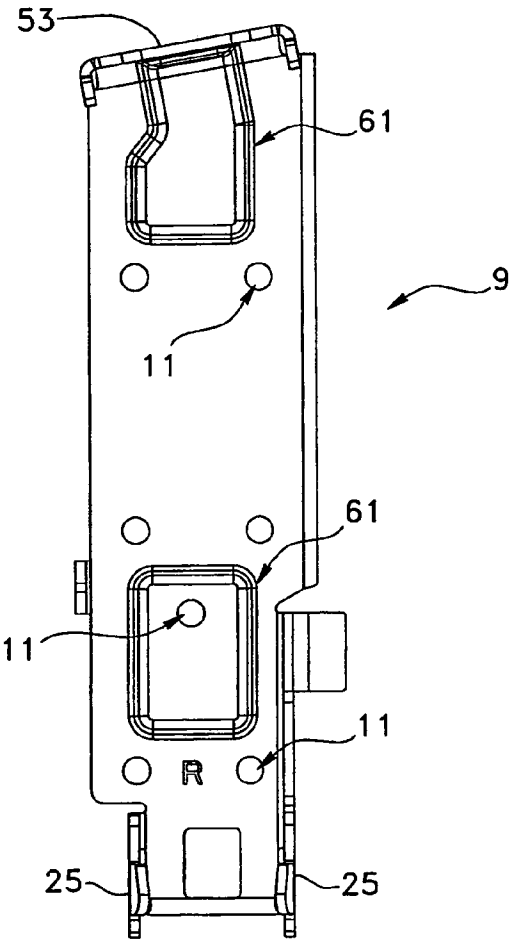
FIG. 26 is a front plan view of the support bracket shown in FIG. 25.
Figure 27:
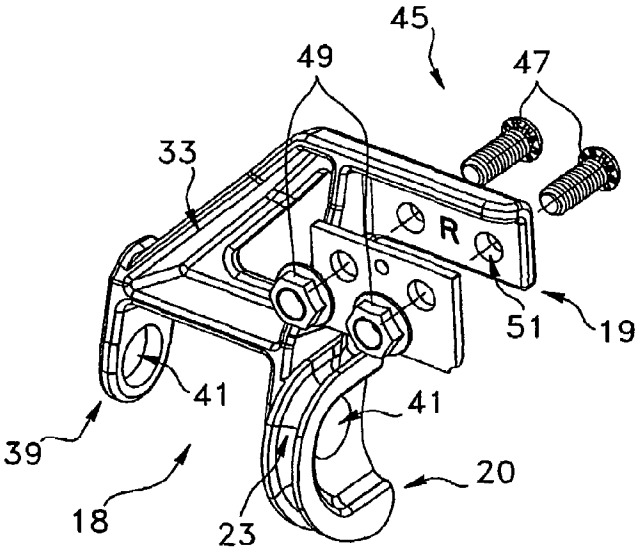
FIG. 27 is an exploded view of the swivel component, including opposite braking arm and lever portion with integrated guiding channel defined therein, of the brake device shown in FIG. 4, the swivel component being shown in an exploded relationship with a corresponding knife and fasteners to be mounted onto the braking arm.
Figure 28:
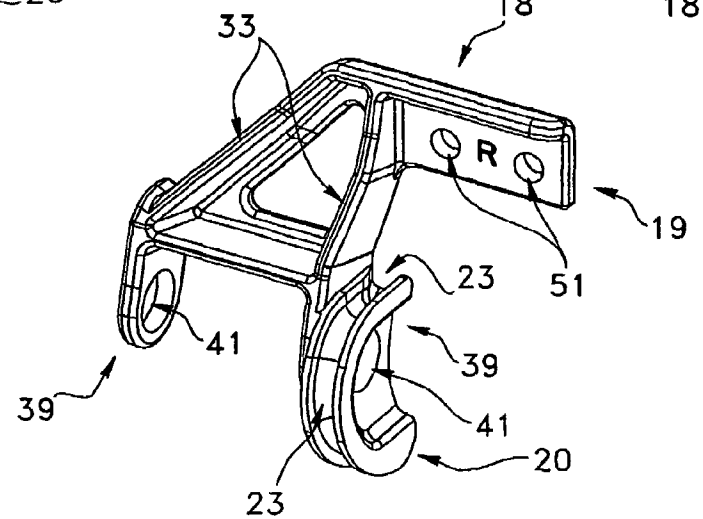
FIG. 28 is another perspective view of the swivel component shown in FIG. 27.
Figure 29:
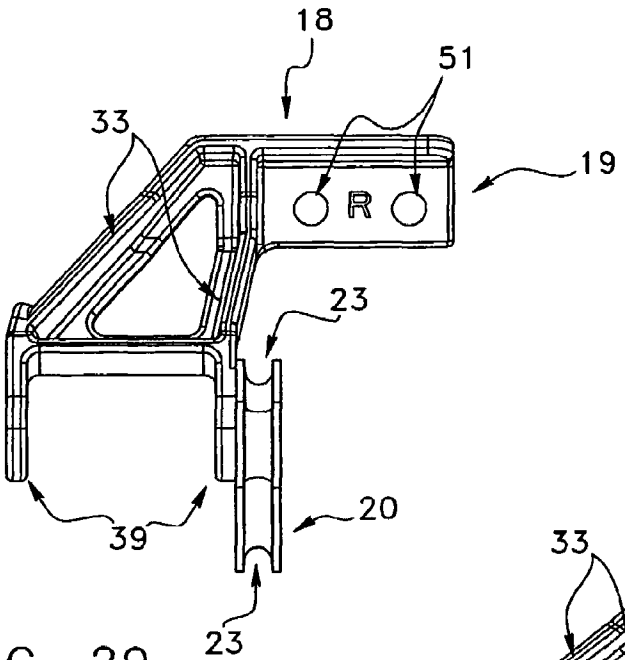
FIG. 29 is a bottom plan view of what is shown in FIG. 28.
Figure 32:
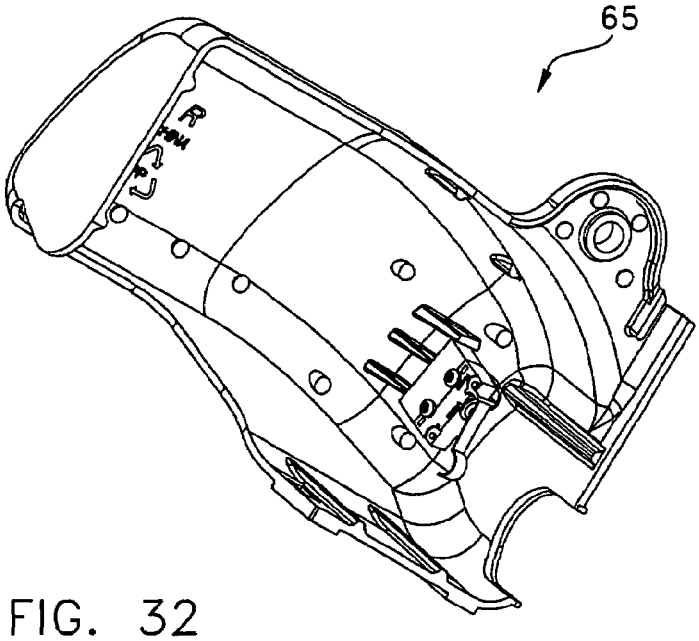
FIG. 32 is a rear perspective view of what is shown in FIG. 30.
Figure 31:
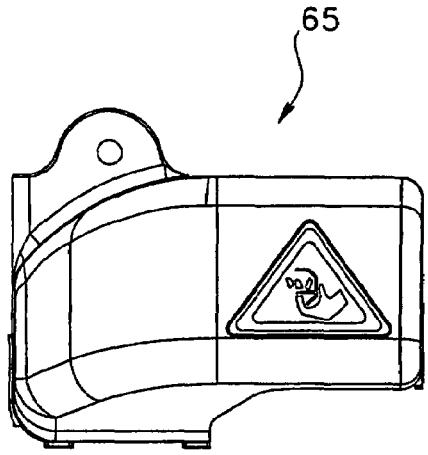
FIG. 31 is a front plan view of what is shown in FIG. 30.
Figure 30:
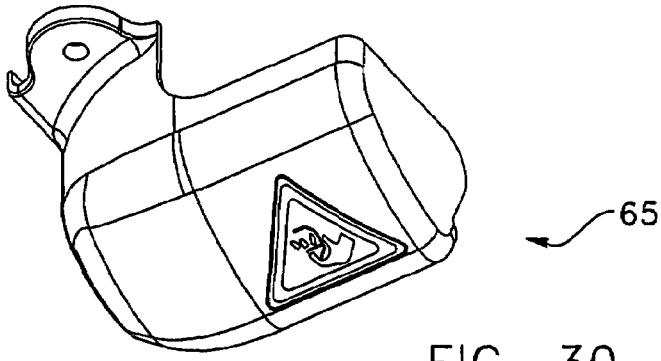
FIG. 30 is a perspective view of a protective casing of the brake device according to a preferred embodiment of the present invention.

As previously explained, the support bracket 9 preferably comprises first and second support arms 25, as better shown in FIGS. 4 and 25, and the guiding assembly 15 preferably comprise a roller 27 mounted about a shaft 29, the shaft 29 being mounted onto the first and second support arms 25 of the support bracket 9, as also better illustrated in FIG. 2. It is worth mentioning that the roller 27 may be pivotally mounted about the shaft 29, and that said shaft 29 may be made integral to the support bracket 9, but preferably, the shaft 29 is pivotally mounted onto the support arms 25 and the roller 27 is securely mounted about said shaft 29 (e.g. by press fitting) so that when the shaft 29 rotates, so does the roller 27. However, as apparent to a person skilled in the art, other dispositions between the shaft 29, roller 27, sleeve 31, and support bracket 9, along with other components, may be made so as to enable the roller 27 to properly guide the cable-operated door 3 along the fixed structure 7, without departing from the scope of the present invention.

It is worth mentioning though that several modifications could be made to the present brake device 1 according to the present invention without departing from the scope of the present invention. Indeed, although the biasing means 21 preferably comprise a loaded spring 63, capable of storing potential energy via deformation so as to provide a potential force urging the hinging portion 33, and thus the braking arm 19, towards fixed structure 7 (e.g. rail) and into a braking configuration, in the event of a loss of tension in the cable, it is worth mentioning however that other suitable biasing means 21 which do not use potential energy for providing a biasing force may be used according to the present invention, so long as these biasing means 21 are capable of biasing the braking arm in a suitable way in the manner discussed above, and as apparent to a person skilled in the art.

Moreover, it is worth mentioning that the biasing means 21 may have other suitable dispositions on the brake device 1 so as to ensure a corresponding biasing force on the braking arm 19, via the hinging portion 33 thereof, for example, according to the present invention.

It is worth mentioning also that, according to the present invention, the different various components of the brake device 1 may be disposed otherwise on the support bracket 9, as also apparent to a person skilled in the art.

Referring to FIGS. 1 and 4, there is shown how the brake device 1 is preferably provided with a casing 65 which is removably mountable onto the support bracket 9 for substantially covering the support bracket 9 and other components operatively connected thereto, such as the support arms 25, the spring 63, the braking arm 19, etc. The casing 65 may be provided with suitable visual information for example, such as the expression "warning" for instance, as illustrated in the figures, or other expressions and/or symbols conveying information.

As can be easily understood from the accompanying drawings, when the braking arm 19 is in the retracted position, the roller 27 of the brake device 1 will guide the door 3 along the rail and the braking arm 19 will travel freely therealong outside the rail. When the braking arm 19 is triggered into the operable position (i.e. braking configuration) by a loss of tension in the cable 5, said loss of tension results in the fact that the cable 5 can no longer push the lever portion 20 of the swivel component 18 and maintain the braking arm 19 away from the fixed structure 7. Namely, the force of the actuating spring 63 becomes greater than the force that was acted upon by the tensioned cable 5 against the braking arm 19 via the lever portion 20, thereby causing the actuating braking arm 19 which is preferably rigidly connected to the hinging portion 33 to rotate the same and thus engage (i.e. anchoring via cutting, notching, etc.) the rail, under the influence of the biasing means 21 (e.g. spring 63), thereby urging the knife 43 against the rail and once anchored therein or engaged thereagainst, preventing and/or slowing down substantially downward movement of the garage door, as apparent to a person skilled in the art. As can be easily understood, this combined action brakes the movement of the cable-operated door 3 and thus reduces the risk of it falling, or at the very least, slow down its descent.

According to another aspect of the present invention, there is also provided a door assembly provided with a brake device 1 such as the one described and illustrated herein.

As may now be better appreciated, the brake device 1 according to the present invention preferably comprises several safety features. For example, as better shown in FIGS. 1 and 4, the brake device 1 preferably comprises a protective casing 65 removably mountable onto the support bracket 9 by suitable attachment means, for protecting the mechanism of the brake device 1 and for preventing access to the mechanism to the general public (i.e. unskilled users). Moreover, as can be easily understood from the accompanying drawings, the braking arm 19 used with the biasing means 21 of the braking device is preferably shaped, sized and positioned to cut into the side rail when triggered into the braking configuration, so as to stop or, at the very least, slow down the descent of the cable-operated door 3.

Moreover, the device shown in the accompanying figures is a "right" brake device 1 to be located at the bottom of the garage door, more specifically at the right-hand side thereof when viewed from the inside of the garage. A "left" brake device 1, that is, a left-hand side version of the brake device 1 shown, would simply be a mirror image of what is in the accompanying figures.

Furthermore, the present invention is a substantial improvement over the prior art in that, by virtue of its design and components, the brake device 1 is simple and easy to use, as well as is simple and easy to manufacture and/or assemble, without compromising the reliability of its functions. Hence, it may now be appreciated that the present invention represents important advantages over other brake devices known in the prior art, namely in terms of performance.

The present invention is also an improvement and presents several advantages over other brake devices known on the prior art in that it may be used in the garage door industry, with new garage doors or existing garage doors, whether commercial or residential. Indeed, in the case of a cable/spring failure, the present invention is intended to stop or at the very least slow down the fall of the garage door 3 so as to minimize or even prevent adverse effects which could otherwise occur if the brake device 1 according to the present invention was not present. Furthermore, the present invention may be used with other kinds of doors, such as slidable truck doors, or with any other items suspended by a cable, as apparent to a person skilled in the art.

Of course, numerous modifications could be made to the above-described embodiments without departing from the scope of the invention, as defined the appended claims.

The invention claimed is:

1. A brake device for a door operated by a tensioned cable, the cable-operated door having a movement guided by a fixed structure, the fixed structure having an inner portion and an outer portion, the brake device being mountable onto the cable-operated door and being configured for cooperating with the tensioned cable so as to immobilize the cable-operated door with respect to the fixed structure in the event of a given loss of tension in the cable, the brake device comprising:

a support bracket mountable onto a bottom portion of the cable-operated door, the support bracket comprising:

at least one hole for receiving a corresponding fastener for securely mounting the support bracket onto the cable-operated door; and a connection point configured for connecting to an extremity of the tensioned cable;

a guiding assembly operatively mounted onto the support bracket for travelling along the inner portion of the fixed structure so as to guide the movement of the cable-operated door along said fixed structure when the support bracket is mounted onto the bottom portion of the cable-operated door;

a braking assembly operatively mounted onto the support bracket for cooperating with the tensioned cable, the braking assembly comprising a swivel component pivotably mounted on and movable about the support bracket, the swivel component having opposite first and second ends, the first end being provided with a braking arm, and the second end being provided with a lever portion positioned about the support bracket for cooperating with the tensioned cable, the braking arm projecting out from the support bracket for positioning of said braking arm adjacent to the outer portion of the fixed structure, the braking arm being operable between a retracted configuration, where the braking arm is urged away from the fixed structure via a frictional engagement of the tensioned cable against the lever portion opposite to the braking arm of the swivel component, so as to allow the guiding assembly to guide the cable-operated door freely along the fixed structure, and a braking configuration, caused by the given loss of tension in the cable resulting in a decrease of the frictional engagement of the lever portion against the cable, where the braking arm is no longer urged away from the fixed structure and thereby engages a portion of the outer portion of the fixed structure for braking the movement of the cable-operated door with respect to the fixed structure, wherein the braking arm is provided with a knife having an edge extending from the braking arm for cutting the outer portion of the fixed structure when in the braking configuration, wherein the knife is removably mounted onto the braking arm with at least one fastener;

biasing means operatively connected between the support bracket and the braking assembly for biasing the braking arm into the braking configuration; and a guiding channel defined within the lever portion of the swivel component for guiding the tensioned cable about the braking assembly and onto the connection point of the support bracket.

2. A brake device according to claim 1, wherein the support bracket comprises a pair of support arms and wherein the guiding assembly comprises a roller mounted about a shaft, said shaft being rotatably attached to said support arms.

3. A brake device according to claim 2, wherein the guiding assembly comprises a sleeve rotatably attached to the support arms, and wherein the shaft of the roller is further rotatably mounted within the sleeve.

4. A brake device according to claim 3, wherein the braking arm has a hinging portion pivotably mounted about the sleeve.

5. A brake device according to claim 4, wherein the hinging portion comprises a pair of hinging flanges each having a corresponding orifice for the sleeve to pass therethrough.

6. A brake device according to claim 5, wherein the guiding channel is operatively connected to the hinging portion of the braking arm.

7. A brake device according to claim 6, wherein the guiding channel is made integral to the hinging portion of the braking arm.

8. A brake device according to claim 1, wherein said at least one fastener comprises a pair of fasteners each comprising a bolt and a corresponding nut, each bolt being insertable through a corresponding hole provided along the braking arm.

9. A brake device according to claim 1, wherein the support bracket comprises a supporting flange, and wherein the connection point comprises a hook having a threaded portion removably insertable into a corresponding hole of the supporting flange.

10. A brake device according to claim 1, wherein the support bracket comprises at least one embossment for increasing the structural integrity of the support bracket.

11. A brake device according to claim 1, wherein the biasing means comprise a spring having one end operatively connected to the support bracket and another end operatively connected to the braking arm.

12. A brake device according to claim 1, wherein the brake device comprises a casing removably mountable onto the support bracket for substantially covering the support bracket.

13. A door assembly having a door operated by a tensioned cable, the cable-operated door having a movement guided by a fixed structure, the fixed structure having an inner portion and an outer portion, the cable-operated door comprising a brake device configured for cooperating with the tensioned cable so as to immobilize the cable-operated door with respect to the fixed structure in the event of a given loss of tension in the cable, the brake device comprising:

a support bracket mountable onto a bottom portion of the cable-operated door, the support bracket comprising:

at least one hole for receiving a corresponding fastener for securely mounting the support bracket onto the cable-operated door; and a connection point onto which an extremity of the tensioned cable is connected;

a guiding assembly operatively mounted onto the support bracket for travelling along the inner portion of the fixed structure so as to guide the movement of the cable-operated door along said fixed structure when the support bracket is mounted onto the bottom portion of the cable-operated door;

a braking assembly operatively mounted onto the support bracket for cooperating with the tensioned cable, the braking assembly comprising a swivel component pivotably mounted on and movable about the support bracket, the swivel component having opposite first and second ends, the first end being provided with a braking arm, and the second end being provided with a lever portion positioned about the support bracket for cooperating with the tensioned cable, the braking arm projecting out from the support bracket for positioning of said braking arm adjacent to the outer portion of the fixed structure, the braking arm being operable between a retracted configuration, where the braking arm is urged away from the fixed structure via a frictional engagement of the tensioned cable against the lever portion opposite to the braking arm of the swivel component, so as to allow the guiding assembly to guide the cable-operated door freely along the fixed structure, and a braking configuration, caused by the given loss of tension in the cable resulting in a decrease of the frictional engagement of the cable with the lever portion, where the braking arm is no longer urged away from the fixed structure and thereby engages a portion of the outer portion of the fixed structure for braking the movement of the cable-operated door with respect to the fixed structure, wherein the braking arm is provided with a knife having an edge extending from the braking arm for cutting the outer portion of the fixed structure when in the braking configuration, and wherein the knife is removably mounted onto the braking arm with at least one fastener;

biasing means operatively connected between the support bracket and the braking assembly for biasing the braking arm into said braking configuration; and a guiding channel defined within the lever portion of the swivel component for guiding the tensioned cable about the braking assembly and onto the connection point of the support bracket.

14. A door assembly according to claim 13, wherein the support bracket comprises a pair of support arms and wherein the guiding assembly comprises a roller mounted about a shaft, said shaft being rotatably attached to said support arms, the guiding assembly further comprising a sleeve rotatably attached to the support arms, and the shaft of the roller being further rotatably mounted within the sleeve.

15. A door assembly according to claim 14, wherein the braking arm has a hinging portion pivotably mounted about the sleeve, wherein the hinging portion comprises a pair of hinging flanges each having a corresponding orifice for the sleeve to pass therethrough, and wherein the guiding channel is made integral to the hinging portion of the braking arm.

16. A door assembly according to claim 13, wherein the support bracket comprises a supporting flange, and wherein the connection point comprises a hook having a threaded portion removably insertable into a corresponding hole of the supporting flange.

17. A door assembly according to claim 13, wherein the brake device comprises a casing removably mountable onto the support bracket for substantially covering the support bracket.

* * * * *